United States Patent [19]

Ando et al.

[11] Patent Number: 4,667,066

[45] Date of Patent: May 19, 1987

[54] LEAF SWITCH

[75] Inventors: Sadao Ando, Chigasaki; Satoshi Saito, Kamakura, both of Japan

[73] Assignee: Yamatake-Honeywell Co. Ltd., Tokyo, Japan

[21] Appl. No.: 770,909

[22] Filed: Aug. 30, 1985

[30] Foreign Application Priority Data

| | | | |
|---|---|---|---|
| Aug. 31, 1984 | [JP] | Japan | 59-181690 |
| Aug. 31, 1984 | [JP] | Japan | 59-181691 |
| Aug. 31, 1984 | [JP] | Japan | 59-181692 |
| Aug. 31, 1984 | [JP] | Japan | 59-181693 |
| Aug. 31, 1984 | [JP] | Japan | 59-181694 |
| Aug. 31, 1984 | [JP] | Japan | 59-181695 |
| Aug. 31, 1984 | [JP] | Japan | 59-181696 |
| Jan. 18, 1985 | [JP] | Japan | 60-5922 |

[51] Int. Cl.[4] ..... H01H 9/00; H01H 13/64

[52] U.S. Cl. ..... 200/1 A; 200/5 R; 200/6 R

[58] Field of Search ..... 200/1 R, 1 A, 1 TK, 200/5 R, 6 B, 6 BB, 6 C, 159 A, 160, DIG. 46, 153 L, 153 LA, 283, 284, 303

[56] References Cited

U.S. PATENT DOCUMENTS

| | | | |
|---|---|---|---|
| 2,833,885 | 5/1958 | Wells et al. | 200/1 R X |
| 2,870,273 | 1/1959 | Merchant | 200/6 BB X |
| 2,872,535 | 2/1959 | Dahlgren | 200/1 A X |
| 3,715,545 | 2/1973 | Long | 200/6 BB X |
| 3,924,090 | 12/1975 | Chao et al. | 200/159 A |
| 4,160,885 | 7/1979 | Ellicott et al. | 200/1 R X |
| 4,384,176 | 5/1983 | Chestnut | 200/1 A |
| 4,547,634 | 10/1985 | Leger | 200/1 A |

*Primary Examiner*—J. R. Scott

*Attorney, Agent, or Firm*—Charles L. Rubow

[57] ABSTRACT

A plunger operated switch having a normally closed pair of contacts and a normally open pair of contacts, the normally closed pair of contacts including a movable contact carried on the free end of a first cantilevered resilient leaf member biased to separate the contacts, the normally open pair of contacts including a movable contact carried on the free end of a second cantilevered resilient leaf member biased to bring the contacts together. An actuator projection on the plunger bears against the first leaf member at a location substantially aligned with the contact thereon, and a further actuator on the plunger bears against the free end of the second resilient leaf member. The plunger is biased to urge the normally closed pair of contacts closed and the normally open pair of contacts open by a spring which is sufficiently strong to overcome the biases of the resilient leaf members.

9 Claims, 22 Drawing Figures

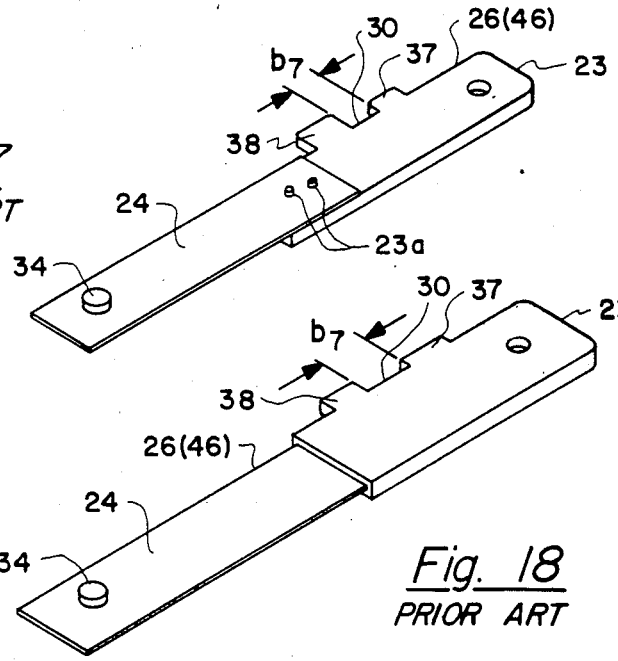
Fig. 17
PRIOR ART
Fig. 18
PRIOR ART
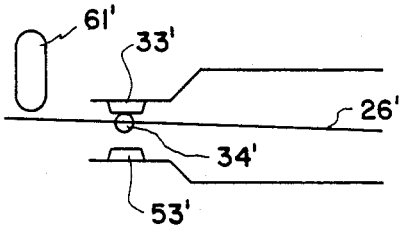
Fig. 19
PRIOR ART
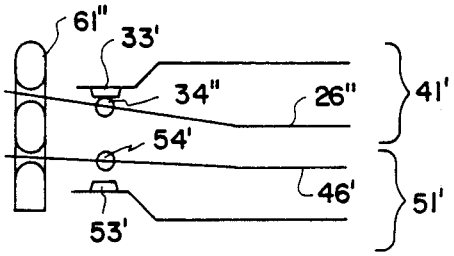
Fig. 20
PRIOR ART
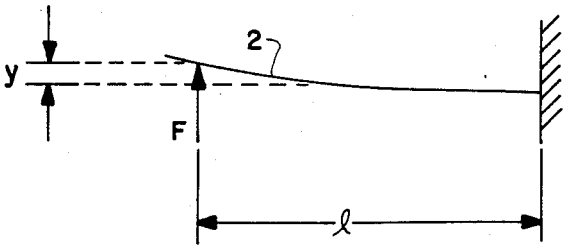
Fig. 21
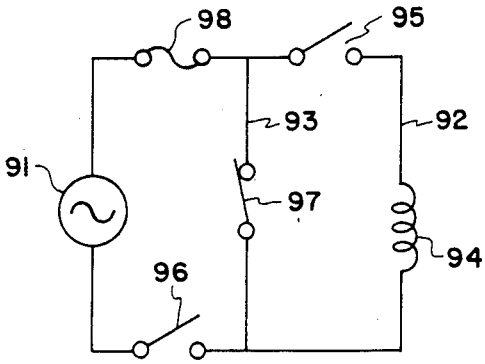
Fig. 22

LEAF SWITCH

BACKGROUND OF THE INVENTION

The invention disclosed herein relates generally to plunger operated switching devices of the type having at least one cantilevered strip carrying a movable contact near its free end, and more particularly to such a device in which contact closure forces are isolated from operator force on the plunger.

A variety of plunger operated switch designs are known in which a movable contact is mounted on a leaf spring. These include three terminal switches having two fixed contacts and a movable contact on a leaf spring which is biased for normal closure with one of the contacts. A plunger operating on the leaf spring may be actuated to press the leaf spring toward the other fixed contacts so as to bring the movable contact into engagement therewith.

Four terminal switch designs are also known utilizing the same principles of operation. In such switch devices, there may be a pair of fixed contacts between which are located a pair of movable contacts, each carried on a leaf spring. The leaf springs may be configured so that the movable contact on one leaf spring is biased for engagement with its adjacent fixed contact and the movable contact on the other leaf spring is biased for separation from its adjacent fixed contact. The leaf springs are maintained at a constant separation and moved relative to the fixed contacts by a plunger which, when actuated, opens the normally closed set of contacts and presses the normally open movable contact into engagement with its adjacent fixed contact.

Such arrangements, and particularly the latter arrangement have certain disadvantages. These stem at least in part from the fact that the switch housing, and consequently the plunger, may not be mounted in a precise or exactly known location relative to the operator which operates the plunger, the plunger may not be precisely located relative to the contacts, and the operator may not always exert the same force on the plunger. Thus, the set of contacts closed by actuation of the plunger may be subject to varying contact forces which could vary the quality of the electrical path.

SUMMARY OF THE INVENTION

The present invention is a leaf switch having normally closed and normally open switching devices, each switching device comprising at least a cantilevered strip carrying a movable contact, the cantilevered strip of the normally closed switching device normally biasing the contacts together and the cantilevered strip of the normally open switching device biasing the contacts to a normally open position. A plunger is urged toward a first position by a spring, in which position a first actuator on the plunger operates to close the normally open set of contacts and a second actuator which serves to open the normally closed set of contacts, the plunger further being operable when depressed toward its second limiting position to allow the normally closed set of contacts to close and allow the normally open set of contacts to open. A housing for the leaf switch may contain an interior partition which separates the interior of the housing into first and second chambers for accommodating the first and second switching devices respectively. At least one of the actuators on the plunger may comprise a projection which abuts the strip carrying the movable normally open contact at a location directly opposite the contact button. Alternatively, the first and second actuators may comprise recesses in the plunger into which the free ends of the strips carrying the movable contacts extend and each of which provides a ridge which bears on the free end of the strip.

BRIEF DESCRIPTION OF THE DRAWINGS

FIG. 17 is an enlarged perspective view of one conventional movable strip element;

FIG. 18 is a perspective view of another strip element fabricated with conventional construction techniques;

FIG. 19 is a schematic illustration of a first prior art leaf switch;

FIG. 20 is a schematic illustration of a second prior art leaf switch;

FIG. 21 is a diagram illustrating the relationship between length, applied force and deflection of a cantilevered strip; and FIG. 22 is a simplified diagram of a circuit in which a switch of the applicants' design may be used.

DESCRIPTION OF THE PREFERRED EMBODIMENTS

Figure 1:
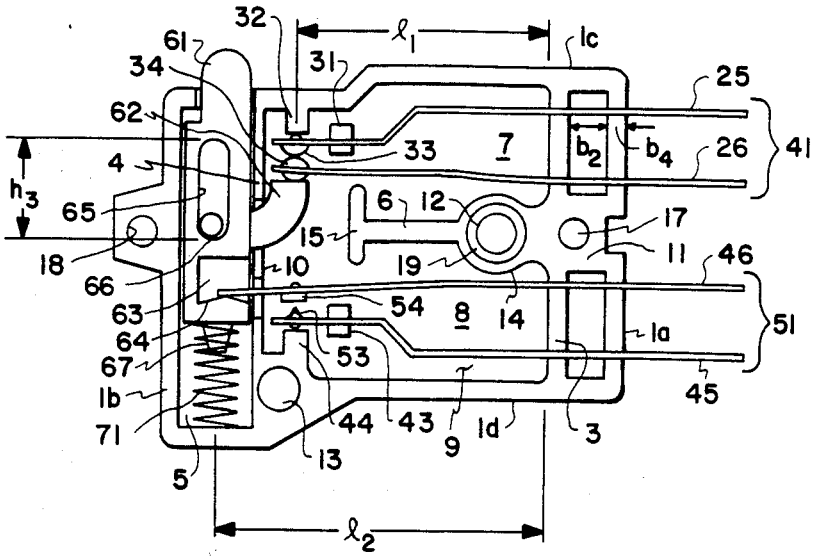
FIG. 1 is a first embodiment of a leaf switch in accordance with the applicants' invention having the cover removed and with the plunger in its rest position.

In order to fully appreciate the applicants' invention, a brief description of the prior art will be presented. Conventional leaf switches include such a switch as shown in FIG. 19 in which a movable piece 26' having a movable contact 34' is disposed between a pair of fixed contacts 33' and 53', and a free end portion of the movable piece is pushed against the resilience of the movable piece by means of a plunger 61' to change over from one fixed contact 33' to the other fixed contact 53'.

Another conventional design is shown in FIG. 20 in which between first and second fixed contacts 33' and 53' there are disposed a first movable piece 26'' having a contact 34'' which is biased to be in contact with the first fixed contact 33' and a second movable piece 46' having a contact 54' which is biased to be out of contact with the second fixed contact 53'. A plunger 61 engages the free end portions of both free end portions to maintain the movable pieces at a predetermined spacing, and, by operation of this plunger, the movable contacts 34'' and 54' are opened and closed with respect to the first and second contacts 33' and 53'.

However, since the movable contacts 34'' and 54' are attached by caulking to the movable pieces 26'' and 46' in positions close to free end portions of the movable pieces which are each formed of a single strip, the portions of the movable pieces 26'' and 46' extending from the attachment of contacts 34'' and 54' to their free end portions are not aligned with the portions thereof extending from the movable contacts 34'' and 54' to the supporting points of the movable pieces. Further, the portions of the movable pieces 26'' and 46' extending from the movable contacts 34'' and 54' to the free end portions thereof are inclined toward or away from the paired fixed contacts 33' and 53'. Consequently, depending on where the plunger 61'' comes into direct abutment with the movable pieces 26'' and 46', the contact pressure of the movable contacts 34'' and 54' against the fixed contacts in deterioration of operating precision of upper switching device 41' in FIG. 20 in which movable contact 34'' is urged in a closing direction by the plunger 61''. In the case of normally open operation like that of lower switching element 51 in FIG. 20, when the movable piece 46' is pressed by the plunger 61'' and the second movable contact 54' is thereby brought together with the second fixed contact 53', a further depression of the plunger 61'' would impose unnecessary stress on the portion of movable piece 46' which carries movable contact 54' and also on the supporting point of the movable piece 46', which may cause breakage of the movable piece. To prevent this, it is necessary to make small the amount of movement of the plunger 61'' which, however, would result in the switch becoming difficult to handle. Besides, the insulating performance is deteriorated because it is necessary to narrow the gap between the movable contact 54' and the fixed contact 53'. Further, since the operating position is inexact and the amount of displacement of the movable piece 46' is limited, the movement or overtravel after a switching operation, especially a closing operation, cannot be made as great as desired, thus making it impossible to obtain a desirable contact pressure. In general, moreover, a cantilever-like movable piece is required to satisfy the antinomy conditions of stress fatigue and contact pressure simultaneously.

In FIG. 21, the state shown in dotted lines represents a free state. If, in this state, an external force F is applied to a free end of the movable piece 2, this movable piece assumes the state shown in solid line. At this time, the force F is as follows:

$$F=[(3EI_y)/l^3]$$

wherein E is a Young's modulus, I is a second moment of area, y is a gap between contacts and l is the distance between the point at which the piece is held stationary and the point at which the force is applied.

The bending stress S is then:

$$S=(Fl)/Z$$

wherein Z is the modulus of a section. The I and Z are constants which are determined by the thickness and width of the movable piece. As the constant pressure approximately corresponding to the force F is increased, the stress S increases as well, so that the movable piece 2 becomes more likely to be fatigued and broken. Particularly, in a small-sized leaf switch, since the effective length l of the movable piece 2 is limited in practice, it is very difficult to decrease the stress of the movable piece 2 and increase the contact pressure.

Referring to FIGS. 1 through 9, there is illustrated a first embodiment of the invention, comprising a generally rectangular housing 1 with a first end wall 1*a* and a parallel support wall 3 at a predetermined spacing from end wall 1*a*. At the other end of housing 1 is an integrally formed second end wall 1*b* and a parallel guide wall 4 at a predetermined spacing from end wall 1*b*, walls 1*b* and 4 defining a guide slot 5 therebetween. Within housing 1 is formed an integral partition 6 extending generally perpendicular to walls 1*a*, 1*b*, 3 and 4, the partition projecting from a bottom portion 9 of the housing.

Partition 6 separates the interior of housing 1 into first and second chambers 7 and 8. One end of partition 6 extends to a reinforcing section 11 between first end wall 1*a* and support wall 3. An intermediate portion of partition 6 is formed as a circular cylinder 14 having a through hole 12 therethrough for a mounting screw (not shown). The other end of partition 6 forms a transverse portion 15 which limits movement of a free end of a first movable element 26 to be described hereinafter.

Reinforcing section 11 is formed with a cylindrical locating indentation 17 having a predetermined depth which extends from a side of the housing 1 toward the bottom portion thereof. Similarly, a locating indentation 18 is formed in a projecting portion 16 of side wall 1*b*. Cylinder 14 has a circular locating recess 19 formed therein from the open side of housing 1, the recess being concentric with through hole 12 and having a diameter larger than that of the through hole. A through hole 13 of the same diameter as through hole 12 is formed in side wall 1*d* at a location adjacent guide wall 4.

On the side of housing 1 defining first chamber 7, first end wall 1*a* and support wall 3 are each formed with a pair of slits 21*a*, 21*b* at a predetermined spacing along the walls. Slits 21 extend from the open side of the housing 1 toward a bottom wall 9 and have a depth less than the height of walls 1*a* and 3. Similarly, on the side of housing 1 defining second chamber 8, first end wall 1*a* and support wall 3 are each formed with a pair of slits 22*a*, 22*b* like slits 21*a*, 21*b*, slits 21 and 22 being formed symmetrically with respect the partition 6.

Slits 21*a* which comprise the slits closest to a first side wall 1*c* are fitted with a first fixed electrically conductive element 25. Element 25 is configured as a single band-like strip having first and second spaced pairs of opposing lugs 27*a*, 28*b* and 28*a*, 28*b* respectively projecting from the edges thereof near one end of the strip. The width $b_1$ of second lugs 28*a* and 28*b* in the longitudinal direction of element 25 is equal to or somewhat larger than a spacing $b_2$ between first end wall 1*a* and support wall 3, and the spacing $b_3$ between adjacent lugs 27 and 28 is larger than the thickness $b_4$ of first end wall 1*a*. Near the other end of the element 25 are formed a third pair of opposing lugs 29*a*, 29*b* projecting from the edges of the element. A round contact button 33 is also attached to one side of element 25 near the same end.

When element 25 is mounted in housing 1, one lug 29*a* contacts a locating projection 31 on bottom wall 9 of housing 1. Also within first chamber 7, first side wall 1*c* is formed with an abutment 32 against which the side of element 25 directly opposite contact button 33 is positioned.

Figure 3:
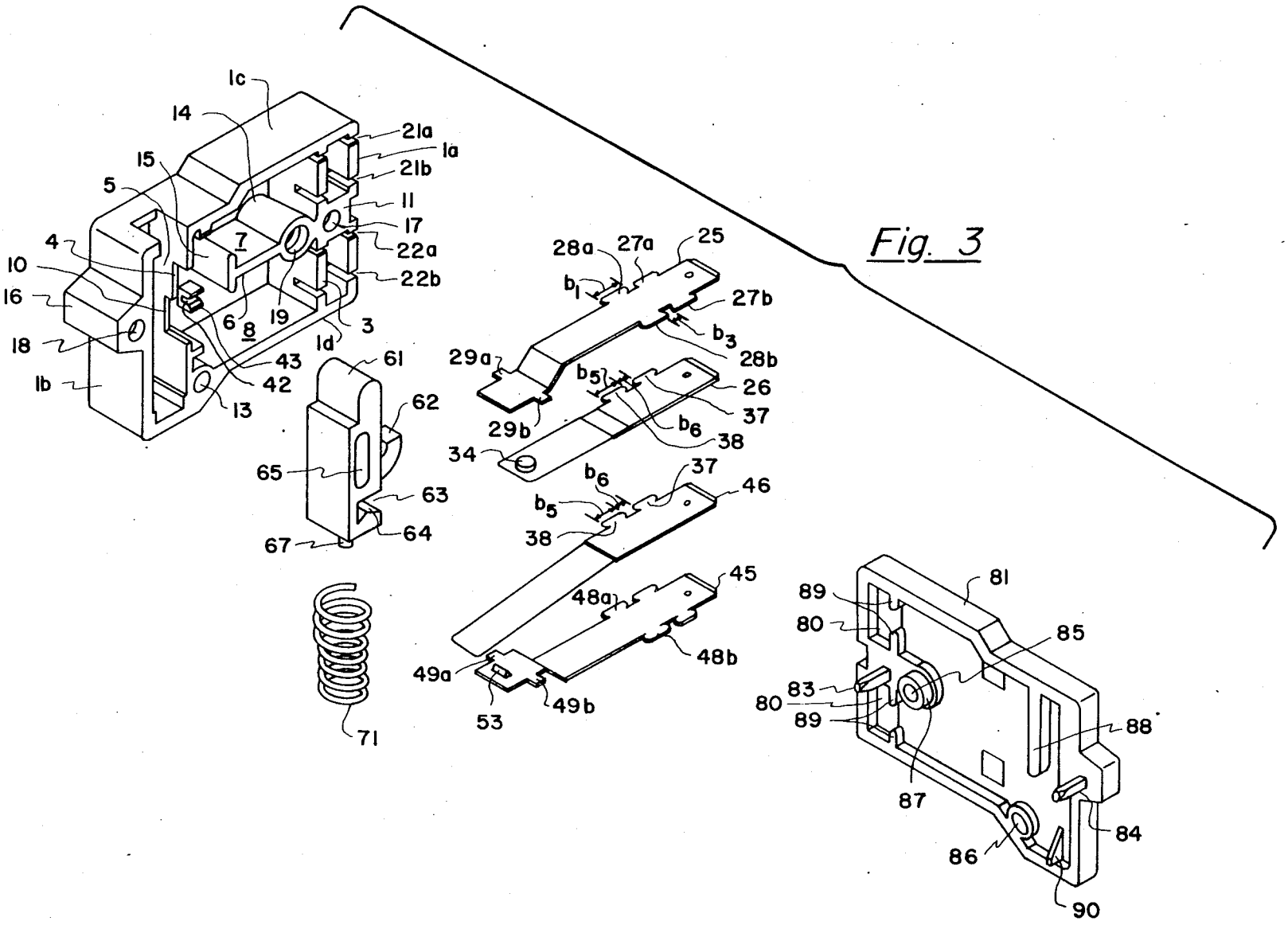
FIG. 3 is an exploded view of the switch embodiment of FIGS. 1 and 2.
Figure 5:
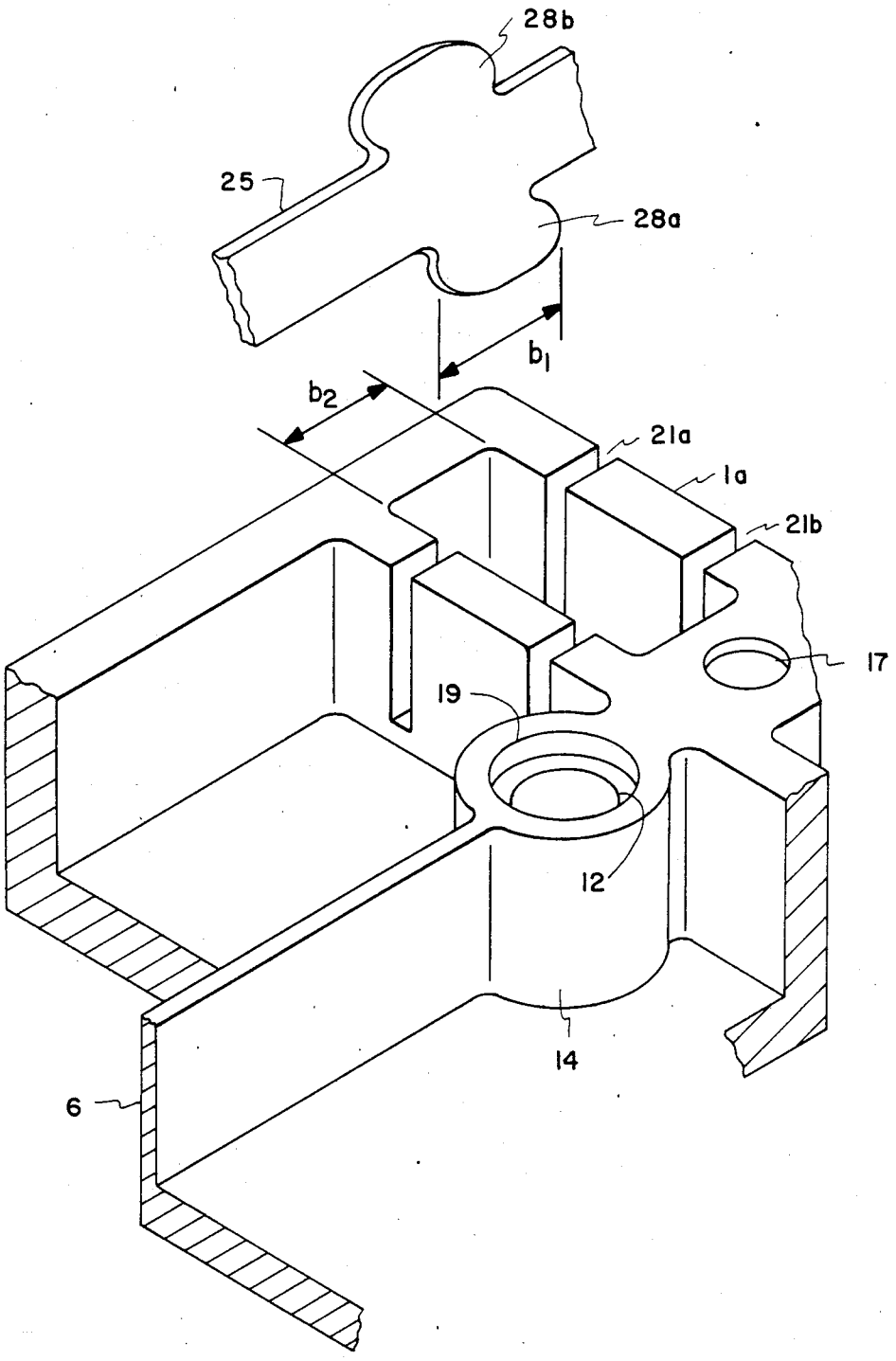
FIG. 5 is an enlarged view of a portion of the switch housing used in FIGS. 1–4 showing the details of the slits into which the cantilevered strips are fitted, and showing a portion of the cantilevered strip having tabs thereon.
Figure 6:
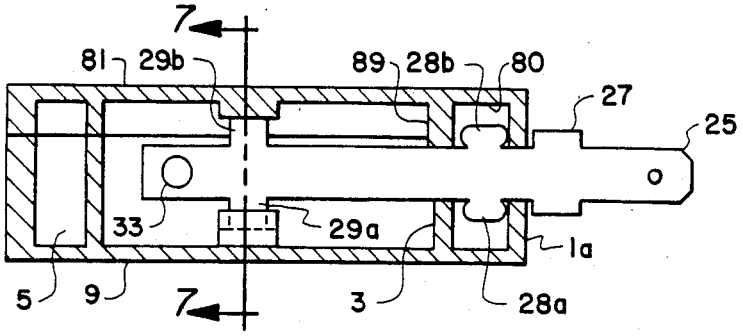
FIG. 6 is a sectional view of a switch in accordance with the applicants' design showing the mounting details of a stationary element in the housing.
Figure 7:
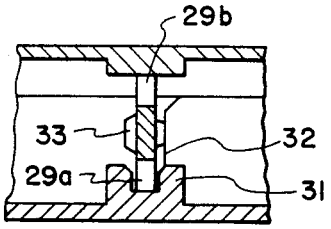
FIG. 7 is a cross-sectional view of the applicants' switch taken along lines 7—7 in FIG. 6.
Figure 8:
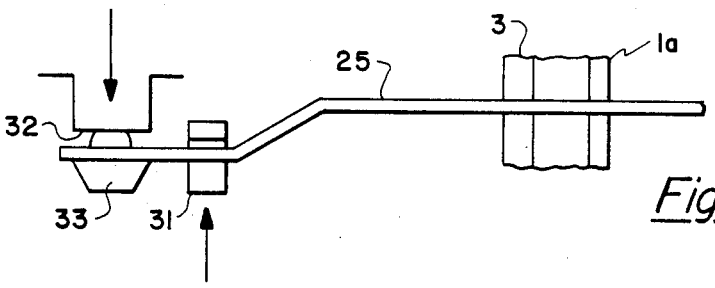
FIG. 8 is an enlarged view of a stationary element of the applicants' switch and its mounting relationship in the switch housing.
Figure 9:
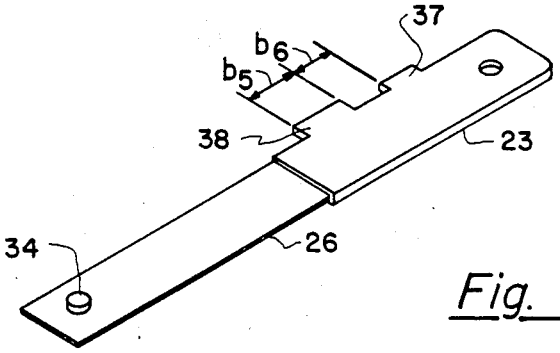
FIG. 9 is an enlarged perspective view of one of the movable elements used in the applicants' switch.

First chamber 7 also accommodates first movable conductive element 26 which is fitted into slits 21*b* adjacent reinforcing section 11. As shown in FIGS. 3 and 9, movable element 26 is in the form of a single resilient band-like strip. One end of the element identified by reference numeral 23 is formed to have approximately double the thickness of the other end by bending and lapping a plate having a double or larger width. The resulting thickness is nearly equal to the thickness of fixed element 25. Tabs 37 and 38 at a predetermined spacing project from one edge of thickened end 23. Like lugs 28*a*, 28*b*, tab 38 has a width $b_5$ which is equal to or slightly larger than the spacing $b_2$ (see FIGS. 1 and 5) between first end wall 1*a* and support wall 3. Further, the spacing $b_6$ between adjacent tabs 37 and 38 is larger than the thickness $b_4$ of the first end wall 1*a*, similar to the spacing $b_3$ (see FIG. 3) between lugs 27*a* and 28*a* of fixed element 25.

The other end or free end of element 26 is provided with a round contact button 34 which may be brought together with similar contact button 33. Element 26 is configured and mounted so as to, in the absence of other influences, maintain a separation between contact button 34 and contact button 33. First stationary element 25 and first movable element 26 constitute a first switching device 41 capable of controlling a relatively large electrical load.

A second fixed conductive element 45 having the same configuration as first fixed element 25 is positioned adjacent a second side wall 1*d* of housing 1. Fixed element 45 carries a contact bar 53 having a wedge-shaped cross section, the contact bar extending in a direction transverse to the length of the element.

In second chamber 8 the bottom wall 9 of housing 1 is formed with a support projection 43 having a slot 42 which is adapted to receive lug 49*a* formed on the edge of second fixed element 45, whereby the contact end of element 45 is secured in a stationary position. An abutment 44 is formed on second wall 1*d* of housing 1. Fixed element 45 rests against abutment 44 at a location on the element on the opposite side of the element from and in approximate alignment with contact bar 53.

In second chamber 8, a second movable conductive element 46 is fitted into slits 22*a* adjacent reinforcing section 11. The second movable element is of the same material and construction as first movable element 26, but, for the switch embodiment of FIGS. 1–3, element 46 is longer than element 26. Also, element 46 carries a contact bar 54 of wedge-shaped cross section at its free end, the contact bar being longitudinally aligned with the movable element 46 so as to intersect fixed contact bar 53. Second movable element 46 is configured and positioned to urge contact bar 54 together with contact bar 53. Thus, a second crossbar switching device 51 is provided for controlling a relatively small electrical load.

Figure 2:
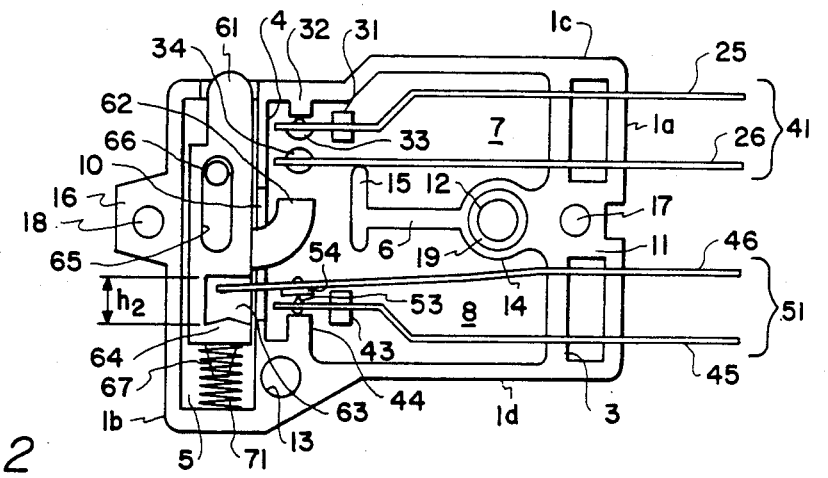
FIG. 2 is a view similar to that of FIG. 1 but with the plunger in its depressed state.
Figure 4:
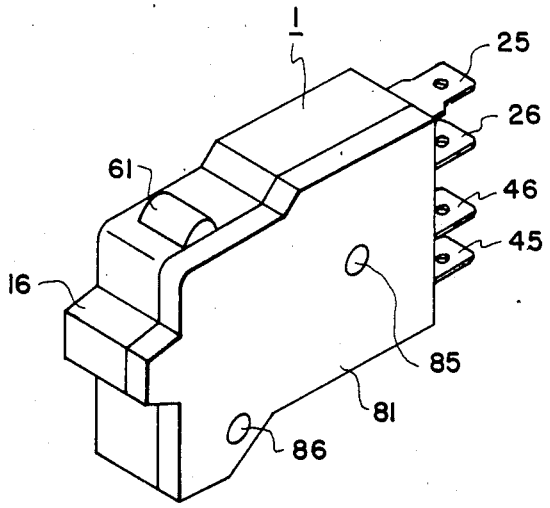
FIG. 4 is a perspective view of the exterior of the switch of FIGS. 1–3.

Guide slot 5 slidably carries a prismatic plunger 61, one end of which extends outwardly through the first side wall of housing 1. Plunger 61 is provided with a first actuator 62 comprising a projection which extends towards the interior of the housing 1 through the notch 10 in guide wall 4, the terminal end of the projection being aligned with contact button 34 on first movable element 26, but on the other side of the element from the contact button. Plunger 61 is also provided with a second actuator 63 comprising a ridge 64 on a surface partially bounding a recess in the plunger, the recess having a predetermined longitudinal dimension $h_2$. Ridge 64 is an a surface end of the recess at one and projects into the recess. The free end of second movable element 46 extends into the second actuator recess 63 and rests on the ridge when plunger 61 is in its rest position. The length of the first movable element 26 from support wall 3 to the point of contact with the first actuator 62 is $l_1$, while the length of the second movable element 46 from support wall 3 to the second actuator ridge is $l_2$. When plunger 61 is in its rest or upward position as shown in FIG. 1, first actuator 62 brings contact button 34 into direct contact with fixed contact 33. At the same time second actuator 63 deflects second movable element 46 and separates contact bar 54 from the fixed contact bar 53. Conversely, when the plunger is in its depressed or downward position as shown in FIG. 2, the first and second actuators are spaced from the first and second movable elements, thereby allowing the biases of elements 26 and 46 to open contacts 33 and 34 of switch device 41 and close contacts 54 and 55 of switch device 51.

Extending through plunger 61 is an elongated aperture 65 of a predetermined length $h_3$ longitudinally oriented in the plunger. Guide slot 5 contains a peg 66 projecting from bottom wall 9 which slidably engages the aperture 65. Aperture 65 and peg 66 are configured and positioned to confine travel of plunger 61 between a first position in which the peg is at one end of the aperture and a second position in which the peg is at the other end of the aperture.

A coil spring 71 is deposed within guide slot 5 between an inner surface of second side wall 1*d* and an end of plunger 61 which has a locating projection 67 thereon. Coil spring 71 is designed to provide a biasing force substantially greater than the sum of the opposing biasing forces produced by first movable element 26 and second movable element 46. Therefore, when plunger 61 is at rest, it is held in its first position which permits the contacts of first switching device 41, to assume their normally closed condition, and which holds the contacts of second switching device 51 open to produce a normally open condition. In connection with the operation of plunger 61 it is pointed out that when the plunger is depressed transverse portion 15 of partition 6 limits movement of movable element 26 toward switching device 51.

A cover 81 for covering the opening side of housing 1 is formed with protrusions 83 and 84 thereon adapted to mate with indentations 17 and 18 respectively. The cross sectional dimensions of these protrusions is equal to or somewhat larger than the inside diameter of indentations 17 and 18 to provide for a press fit between the body and the cover. Cover 81 is also formed with through holes 85 and 86 located to be aligned with through holes 12 and 13 respectively. The wall surrounding hole 85 is integrally formed with a cylindrical portion 87 adapted to extend into locating recess 19 formed in housing 1. Cover 81 is also formed with a ridge 88 which cooperates with guide wall 4 to guide plunger 61 for slidable movement in guide slot 5. Further, the portion of the cover corresponding to the lower end of guide slot 5 is formed with a tapered guide projection 90 for guiding the lower end of spring 71. Finally, the portions of the cover corresponding to the first end wall 1*a* and the support wall 3 are configured to come into transverse abutment with one edge of each of stationary elements 25 and 45 and movable elements 26 and 46. In particular, short ridges 89 corresponding to wall 3 are formed for that purpose.

Fixed elements 25 and 45 are preformed with an outward jog therein so that the outsides of respective fixed contacts 33 and 53 are resiliently held against abutments 32 and 44 when the stationary elements are fitted into slits 21*a* and 22*b*. When the cover 81 is in place, lugs 28*b* and 48*b* of the fixed elements 25 and 45 respectively are positioned in recesses 80 formed in cover 81, while lugs 29*b* and 49*b* bear against the inner surface of the cover. Further, edges of stationary fixed elements 25 and 45 and movable elements 26 and 46 bear against ridges 89 of the cover 81, whereby the fixed and movable elements are held in place.

Figure 10:
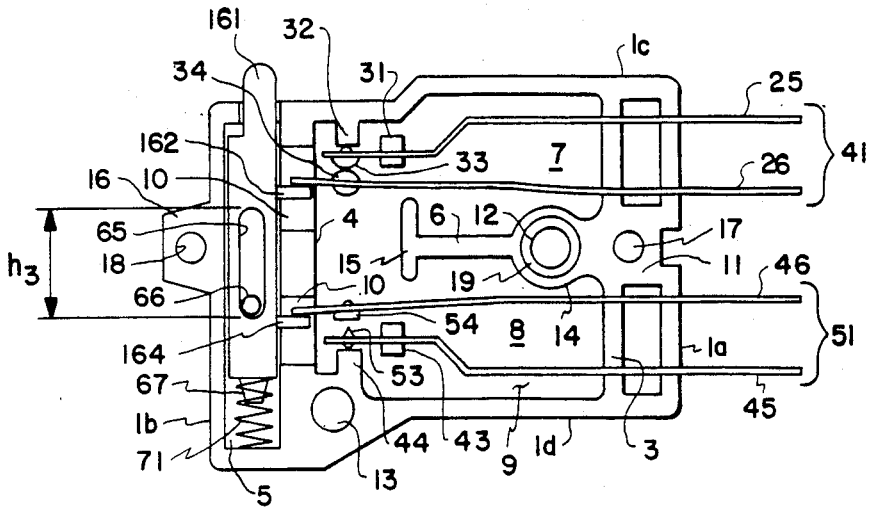
FIG. 10 is a view of a second embodiment of a switch in accordance with the applicants' design with the cover removed and the plunger in its rest position.
Figure 11:
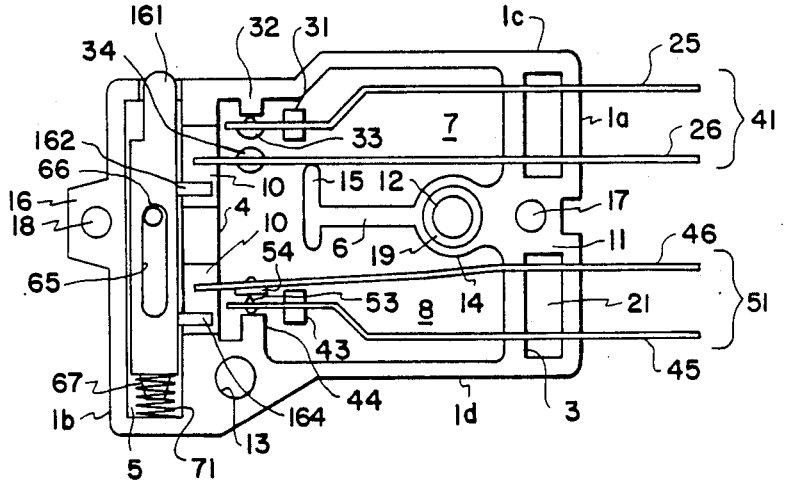
FIG. 11 is a view of the switch embodiment of FIG. 10 with the plunger in its depressed state.
Figure 14:
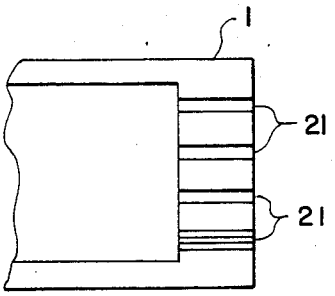
Fig. 14 PRIOR ART
FIG. 14 is a partial view of a switch housing of prior art design having strip element mounting slits therein.
Figure 15:
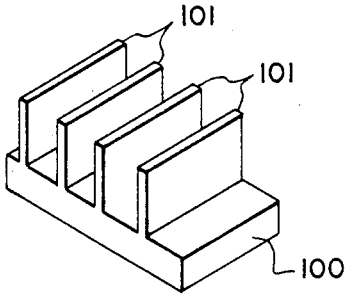
Fig. 15 PRIOR ART
FIG. 15 is a perspective view of a die for molding the slits illustrated in FIG. 14.
Figure 12:
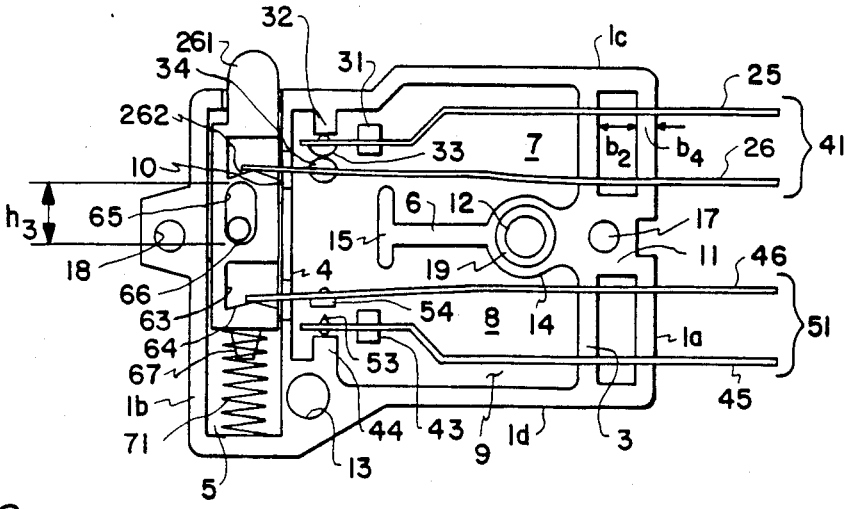
FIG. 12 is a view of a third embodiment of a leaf switch in accordance with the applicants' design with the cover removed and the plunger in an undepressed state.
Figure 13:
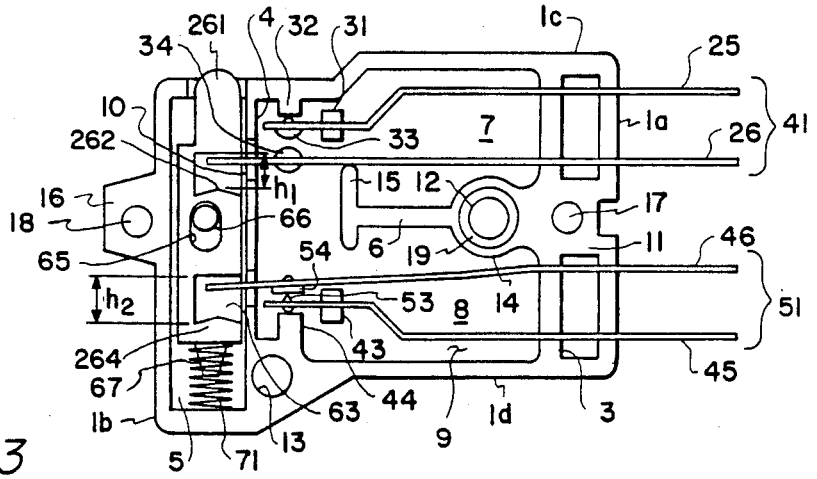
FIG. 13 is a view of the switch embodiment of FIG. 12 with the cover removed and the plunger in a depressed state.
Figure 16:
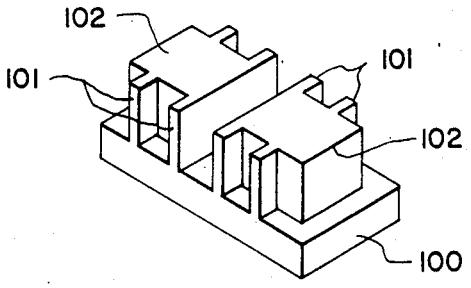
FIG. 16 is a perspective view of a die for molding the strip element mounting slits in the switch housing of the applicant's design.

FIGS. 10 and 11 illustrate a second embodiment of the present invention and FIGS. 12 and 13 illustrate a third embodiment of the invention. The second and third embodiments are similar to the embodiment of FIGS. 1–9 except primarily for the plunger design. The same reference numerals are used for identical parts in all three embodiments, and functionally equivalent parts in the second and third embodiments are designated by 100 or 200 series numerals respectively.

In the embodiment of FIGS. 10 and 11 the plunger is identified by reference numeral 161, and reference numerals 162 and 164 identify first and second actuators respectively on the plunger. Both actuators comprise laterally extending projections, actuator 162 extending to a position to engage the free end of movable element 26 and actuator 164 extending to a position to engage the free end of element 46 when the plunger is in its rest position. As in the embodiment of FIGS. 1–9, actuators 162 and 164 function respectively to allow contact 34 to move away from contact 33, and contact 54 to bear against contact 53 when the plunger is depressed.

In the embodiment of FIGS. 12 and 13 the plunger is identified by reference numeral 261 and both actuators comprise ridged surfaces in recesses in the plunger adapted to engage the free ends of movable elements 26 and 46. Actuator surfaces 262 and 264 of the recesses which bear on the movable elements 26 and 46 respectively when the plunger is in its rest position are wedge shaped so as to provide only a line contact between the actuators and the movable elements as shown, the recesses of actuators 62 and 63 have dimensions $h_1$ and $h_2$ respectively along the direction of travel of the plunger so as to provide the desired amount of overtravel without subjecting movable elements 26 and 46 to excessive deflection and stress.

FIG. 22 illustrates a microwave range circuit as an example of an application for the leaf switch of the present invention. A load circuit 92 having a load device 94, e.g., a magnetron, is connected to a power source 91, and a monitor circuit 93 is connected in parallel with the load circuit, with a monitor switch 97 being disposed in the monitor circuit. A fuse 98 is provided between the monitor circuit 93 and the power source 91, and latch switches 95 and 96 are disposed between the load circuit 92 and the power source 91. The latch switches 95 and 96 function to open and close the load 94 in interlock with opening and closing of a door. The monitor switch 97 is open when the door is closed and becomes closed when the door is open, and it short-circuits the load 94 and thereby allows the fuse 98 to blow when the latch switches 95 and 96 fail to open. With reference to the switch embodiment of FIGS. 1–9, switching device 41 may serve as monitor switch 97. The second switching device 51 is then used for opening and closing a microcomputer circuit (not shown), and it is closed when the door is closed.

Although several embodiments of the invention are described in detail for exemplary purposes, it is apparent that a number of variations and modifications are within the applicant's contemplation and teaching. The scope of coverage is to be determined only by the following claims.

The embodiments of the invention in which an exclusive property or right is claimed are defined as follows:

1. A leaf switch including:

a normally closed switching device comprising a first stationary element having a first contact thereon and a first movable element having a second contact thereon which may be brought together with the first contact, the first movable element including a first resilient leaf member biased to urge the second contact away from the first contact;

a normally open switching device comprising a second stationary element having a third contact thereon and a second movable element having a fourth contact thereon which may be moved away from the third contact, the second movable element including a second resilient leaf member biased to urge the fourth contact toward the third contact;

a housing in which said normally closed and normally open switching devices are mounted;

a plunger slidably mounted in said housing and adapted to deflect said first and second movable elements against the biases of the first and second resilient leaf members, said plunger having a first actuator in the form of a projection positioned to bear on the first movable element at a location substantially aligned with the second contact in the direction of its movement, said plunger having a second actuator positioned to bear on the second movable element; and a spring disposed between said plunger and said housing and urging said plunger in a direction which deflects said first and second movable elements so as to close said normally closed switching device and open said normally open switching device, said spring being sufficiently strong to overcome the biases of the first and second resilient leaf members.

2. A leaf switch as set forth in claim 1, wherein the first and second contacts comprise round contacts having relatively large current carrying capacity, and the third and fourth contacts comprise bar contacts having wedge-shaped cross sections, the bar contacts crossing each other and having relatively small current carrying capacity.

3. A leaf switch as set forth in claim 1, wherein said second actuator is located in a recess in said plunger into which the second movable element extends.

4. A leaf switch as set forth in claim 3, wherein said second actuator is in the form of a ridge on a surface partially bounding the recess in said plunger, the ridge projecting into the recess.

5. A leaf switch as set forth in claim 4, including a plunger travel limiting arrangement which comprises an elongated aperture in said plunger and a peg which projects from said housing and extends into the elongated aperture to prevent the bounding surface of the recess opposite the ridge from coming into contact with the second movable element.

6. A leaf switch as set forth in claim 1, wherein:

said first and second movable elements and said first and second stationary elements each comprise a leaf member having a contact thereon and having a lug of a predetermined width on an edge thereof at a location remote from the contact; and said housing includes a first end wall and a support wall substantially parallel with the first end wall at a spacing therefrom substantially equal to the predetermined width of the lugs on the leaf members, the end wall and support wall having parallel transverse slits therethrough receiving the edges of the leaf members with the lugs being located between the first end and support walls, whereby the leaf members are arranged substantially in parallel in said housing.

7. A leaf switch as set forth in claim 6, wherein said housing is formed with an abutment on the opposite side of each of said first and second stationary elements from the contact thereon, each abutment being substantially aligned with the contact in the direction of movement of the contact on the associated movable element.

8. A leaf switch as set forth in claim 7, wherein said housing includes a second end wall opposite the first end wall and a guide wall parallel with and spaced from the second end wall to form a guide channel therebetween in which said plunger is slidably mounted.

9. A leaf switch as set forth in claim 8, wherein each of the leaf members of said first and second movable elements comprises a resilient strip of which a portion is folded on itself to form a reinforced segment in the area thereof received in the slits in the first end and guide walls of said housing.

* * * * *